US006127659A

United States Patent [19]

Friedman et al.

[11] Patent Number: 6,127,659

[45] Date of Patent: Oct. 3, 2000

[54] FOOD WARMER

[75] Inventors: Nitai Friedman; Roni Dabora, both of Montreal, Canada

[73] Assignee: Hardt Equipment Manufacturing Inc., Canada

[21] Appl. No.: 09/300,360

[22] Filed: Apr. 26, 1999

[51] Int. Cl.[7] ..... A21B 1/00

[52] U.S. Cl. ..... 219/398; 219/462.1; 392/432

[58] Field of Search ..... 219/216, 448.11, 219/448.13, 448.14, 448.17, 462.1, 464.1, 465.1, 466.1, 467.1, 521, 385, 494, 452.11; 392/432, 435

[56] References Cited

U.S. PATENT DOCUMENTS

| | | | |
|---|---|---|---|
| 4,145,603 | 3/1979 | Mackay et al. | 219/448.11 |
| 4,150,280 | 4/1979 | Hurko | 219/466.1 |
| 4,237,368 | 12/1980 | Welch | 219/448.17 |
| 4,286,377 | 9/1981 | Hurko et al. | 219/448.17 |
| 4,394,564 | 7/1983 | Dills | 219/448.17 |
| 4,700,051 | 10/1987 | Goessler et al. | 219/448.11 |
| 5,059,770 | 10/1991 | Mahawili | 219/448.17 |
| 5,105,064 | 4/1992 | Kresock | 219/216 |
| 5,283,412 | 2/1994 | Gouardo et al. | 219/448.13 |
| 5,294,778 | 3/1994 | Carman et al. | 219/385 |
| 5,347,609 | 9/1994 | Huff | 219/452.11 |
| 5,352,864 | 10/1994 | Schultheis et al. | 219/448.17 |
| 5,397,873 | 3/1995 | Stoops et al. | 219/448.17 |

*Primary Examiner*—Teresa Walberg
*Assistant Examiner*—Fadi H. Dahbour
*Attorney, Agent, or Firm*—Wallenstein & Wagner, Ltd.

[57] ABSTRACT

A heating plate for a food warmer is disclosed. The heating plate has a surface for supporting an article to be heated and a plurality of heating clusters attached to the surface. Each heating cluster has a thermostat and a plurality of heating elements spaced around the thermostat. Each heating element is operably controlled by the thermostat.

34 Claims, 5 Drawing Sheets

FOOD WARMER

TECHNICAL FIELD

This present invention relates generally to food warmers. More specifically, it relates to a food warmer having an independently-controlled partitioned heating plate.

BACKGROUND OF THE INVENTION

Food establishments such as grocery stores and fast-food establishments often utilize food warmers to maintain prepared food at a constant predefined temperature. These establishments are required by law to keep such food items at the predefined temperature. For example, health and safety regulatory agencies mandate that perishable meat items be maintained at or above 140 degrees F. The food warmers typically have a warming plate enclosed by a support structure. The support structure has a door or other opening for access to the warmer. Employees or customers are allowed to take food items from the food warmer as desired.

However, conventional food warming equipment and hot merchandising equipment have proven unsatisfactory in maintaining food at the required temperature under certain conditions. In some instances, there is no feedback of the current temperature of the food warmer, i.e., no feedback between the heat applied and the heat extracted (by the food and environment) from the food warmer. Heating elements in those instances merely supply a constant power input to keep the food warmer enclosure at an expected resulting temperature. However, environmental effects such as the ambient room temperature, actual voltage of the power supply, and manufacturing tolerances of the electrical elements will effect the actual temperature at which the food is maintained. The ambient room temperature effects are increased by persons opening the food warmer to retrieve or replace food items in the food warmer. Additionally, when unheated food items are placed in the food warmer, the lack of feedback will allow the overall temperature of the food warmer to decrease due to conductive heat transfer between the warmer and the food item. This will, in turn, cause the temperature of other food items being heated by the warmer to decrease below the required temperature.

To combat this problem, food warmers employing a feed back device, such as a thermostat, have also been employed. A problem with these food warmers is that the single thermostat cannot detect temperature variances across the food warmer. Temperature variances are introduced in the food warmer by air drafts at ambient temperature or being placed adjacent to refrigeration units, as well as by placing unheated food items on the food warmer. Because the thermostat will only detect the temperature of the food warmer at one location, a decrease in temperature of a section of the food warmer remote from the thermostat will not be detected. Likewise, if the section of the food warmer near the thermostat decreases in temperature, the thermostat reacts by supplying energy to the heating elements over the entire food warmer, thereby overheating remote sections of the food warmer. Thus, food items can be overheated to compensate for inadequate heating in other areas of the food warmer.

U.S. Pat. No. 5,590,587 to Polster ("Polster") discloses a food cooker/rethermalizer wherein food items are heated in a water bath. Polster uses two thermostats 81*a* and 81'*a* to sense the temperature of the water bath within a water compartment divided into zones A, B, C. Based on the average temperature sensed by the thermostats 81*a*, 81'*a*, a heater 80 is supplied or not supplied energy to maintain a desired temperature of the water bath. Polster, however, cannot sense for temperature variances across the water bath. Rather, Polster anticipates a temperature variance by using the average temperature of the water bath at two locations to control the heating element. Also, by placing only one heating element 80 in the food cooker/rethermalizer, disposed at one end of the water compartments A, B, C, Polster does not attempt to eliminate any temperature variance within the compartments A, B, C.

The present invention is provided to solve these and other problems.

SUMMARY OF THE INVENTION

The present invention relates to food warmers. In a first aspect of the invention, a heating plate is provided having a surface for supporting an article to be heated. A plurality of heating clusters are attached to the surface and form a partitioned heating plate. Each heating cluster comprises a temperature control device, such as a thermostat, and at least one heating device positioned near the thermostat or a plurality of heating devices spaced about the thermostat. Each heating element is operably connected to the temperature control device which in a preferred embodiment is a thermostat. In the case of a heating device which is either an electrically resistive heating element or Peltier cooler type element, the thermostat is operably controlled by the heating element by being electrically connected to the thermostat. In the case of a heating element which is a flame combustion heating element, the heating element is operably controlled by the thermostat by controlling a supply of a combustible fuel to the heating element. Other heating devices are also possible.

In another aspect of the invention, the heating elements are disposed within a single plane and the thermostats are located within the plane.

In a further aspect of the invention, the heating plate comprises two plates, each made of a different material.

In another aspect of the invention, the heating cluster comprises three heating elements spaced about a thermostat at a spacing of 120 degrees.

In another aspect of the invention, adjacent heating clusters are rotated a certain distance to provide maximum coverage of heating elements over the surface area of the heating plate.

Other aspects and features of the invention will be apparent from the following specification taken in conjunction with the following drawings.

DETAILED DESCRIPTION OF THE INVENTION

Figure 1:
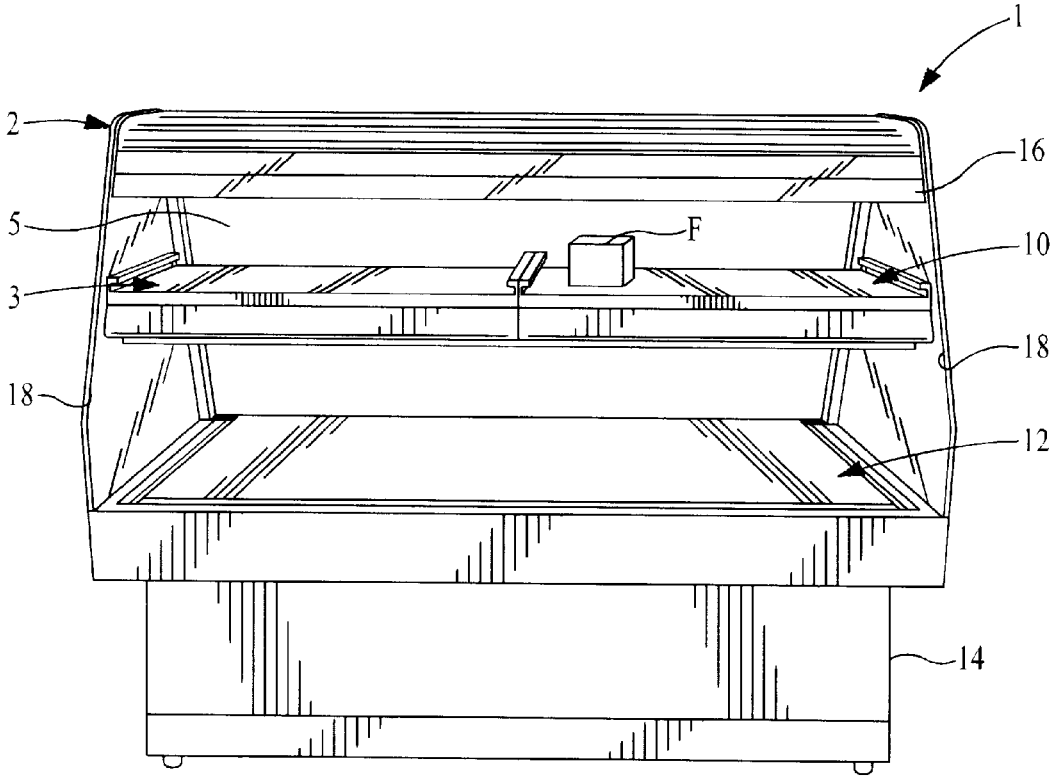
FIG. 1 is a perspective view of a food warming system having a food warmer according to the present invention.

While the invention is susceptible of embodiment in many different forms, there is shown in the drawings and will herein be described in detail preferred embodiments of the invention. It is to be understood that the present disclosure is to be considered only as an example of the principles of the invention. This disclosure is not intended to limit the broad aspect of the invention to the illustrated embodiments. The scope of protection should only be limited by the accompanying claims.

Figure 2:
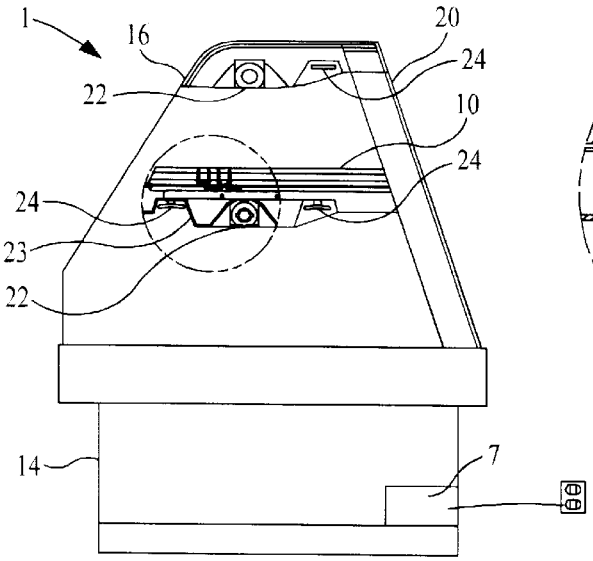
FIG. 2 is a side elevational view of the food warming system of FIG. 1.

Referring to FIGS. 1 and 2, a food warming system 1 is disclosed and generally comprises a support structure 2 and a heating assembly 3. The heating assembly 3 generally comprises an upper heating plate 10 and a lower heating plate 12 with an associated heating/power mechanism that will be described in greater detail below.

The support structure generally comprises a base 14, a transparent top cover 16, side supports 18 and a rear support 20. Thus, the support structure forms a display case 5 or chamber wherein food items are placed on the heater plates 10,12 to be taken by personnel or customers as desired. The base 14 directly supports the lower heating plate 12, which spans between the side supports 18. The upper heating plate 10 is supported above the lower heating plate 12 by the side supports 18 and rear support 20. The upper heating plate 10 also spans between the side supports 18. Incandescent lights 22 are disposed above the heating plates 10,12. Also, if desired, the food warmer 1 can include radiant heat sources 24 for additional heating. The radiant heat sources 24 serve to keep the air and upper surfaces of food items within the food warmer 1 warm. In one preferred embodiment, however, the radiant heat sources 24 are not employed. The incandescent lights 22 serve to keep the display case 5 bright so that consumers may see into the display case 5 and may also be used to supplement the energy delivered to the food warmer 1. Energy from the incandescent lights 22 is directed downward toward the food items resting on the heating plates 10,12. Rear doors may also be incorporated into the rear support 20 in order to provide access to the heating plates 10,12. Deflection plates 23 may also be incorporated to deflect heated air toward the foot items placed on the heating plates 10,12. In the embodiment of FIG. 1, the heating plates 10,12 are accessed from the front of the warmer 1 which is generally open. It is also understood, however, that the transparent top cover 16 could be extended and provided with a door to fully enclose the heating plates 10,12.

Figure 3:
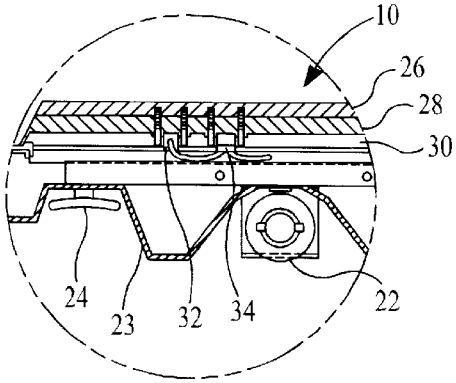
FIG. 3 is an enlarged partial cross-sectional view of a heating plate shown in FIG. 2 according to the present invention.
Figure 4:
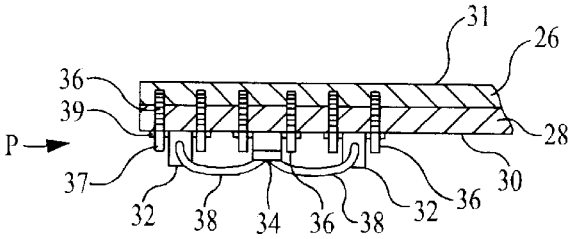
FIG. 4 is a partial cross-sectional view of the heating plate according to the present invention.

The heating assembly 3 generally includes the heating plates 10,12, heating elements 32, temperature control devices such as thermostats 34, and associated wiring and power sources. FIG. 3 discloses an enlarged partial view of the upper heating plate 10. FIG. 4 also discloses a partial view of the heating plate 10,12. The structure of one heating plate will be described with the understanding that both the upper heating plate 10 and the lower heating plate 12 are similarly constructed. The heating plates 10,12 provide a support surface and are adapted to support articles to be heated such as food items.

Each heating plate 10,12 preferably comprises a thermally conductive member. In a preferred embodiment, each heating plate 10,12 comprises an upper metal plate 26 and a lower metal plate 28, although a single conductive plate could be used. The metal plates 26, 28 are preferably made from two different materials. The lower metal plate 28 is selected from materials that are especially good conductors of heat, such as aluminum, so that the temperature of the lower metal plate 28 is substantially constant over its surface. The lower metal plate 28 is sometimes referred to as a "spreader plate" because it helps to optimally spread the applied heat over the entire heating plate 10,12 through its thermally conductive properties. The lower metal plate 28 further acts as a conduit between the heating devices 32 and temperature control devices 34 to thermally couple the devices 32, 34, thereby preventing thermal runaway. In a food-related application, the upper metal plate 26 is preferably selected from materials that do not oxidize when wet and are easily cleaned, such as stainless steel. The lower metal plate 28 is positioned adjacent to the upper metal plate 26 wherein the plates 26, 28 are in surface-to-surface contact with one another. In addition, corresponding openings are formed into the metal plates 26, 28 and are adapted to receive studs as described below. When the metal plates 26, 28 of the heating plates 10,12 are positioned in the food warmer 1, a bottom surface 30 of the lower metal plate 28 faces downward and a top surface 31 of the upper metal plate 26 faces upward. The bottom surface 30 supports heating elements 32 and thermostats 34 as described below while the top surface 31 supports items to be heated such as food items F (FIG. 1). The heating elements 32 can be considered to include a source of power for supplying energy to the elements 32 to heat the plate 10,12 as is conventional. In one variation, the heating plates 10,12 can be coated with Teflon® material.

As further shown in FIG. 4, heating devices 32 and temperature control devices 34 are mounted on the bottom surface 30 of the lower metal plate 28. In a preferred embodiment, the heating devices 32 are electrically resistive heating elements 32 and the temperature control devices 34 are thermostats 34. The types of thermostats 34 used could be simple on-off type thermostats or proportional control thermostats which supply a voltage to the heating elements 34 which is proportional to the temperature detected. Other modulated solid-state devices could also be used. Studs 36 are inserted into the openings in the metal plates 26, 28. The studs 36 pass completely through the lower metal plate 28 and partially into upper metal plate 26. A portion 37 extends out of the lower metal plate 28. In a preferred embodiment, the studs 36 are self-clinching studs, known in the art, that are squeezed into place. Other types of mountings are also possible that can provide a tight mechanical fit between the metal plates 26,28 and devices 32,34. Each heating element 32 and thermostat 34 is attached to the lower metal plate 28 with two threaded studs 36 and two nuts 39. Each resistive heating element 32 is attached to the thermostat 34 by a wire 38, as explained in greater detail below. The heating elements 32 and thermostats 34 are attached such that they are in surface-to-surface contact with the bottom surface 30. In a preferred embodiment, a plurality of heating elements 32 and thermostats 34 are utilized in the heating plates 10,12.

Figure 5:
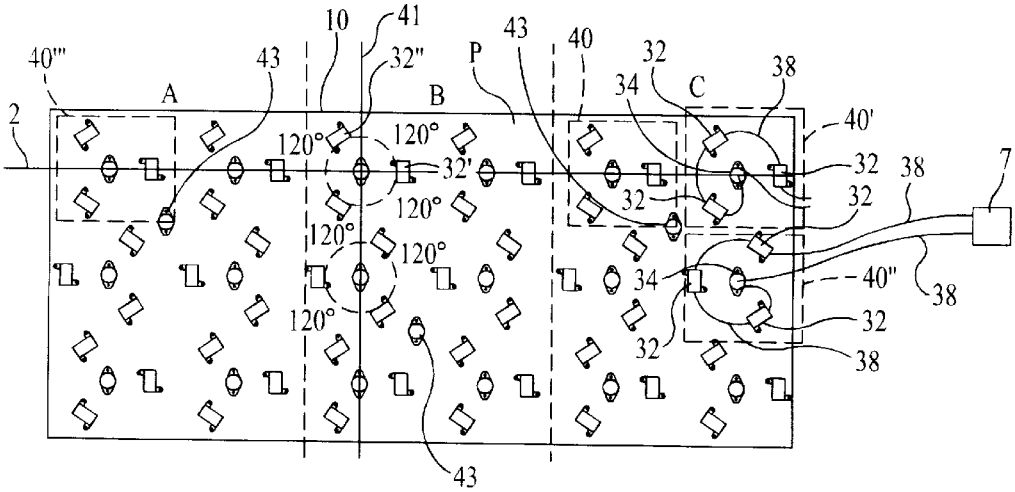
FIG. 5 is a bottom plan view of the heating plate according to the present invention.

FIG. 5 discloses a bottom plan view of the heating plate 10,12 and specifically the bottom surface 30 of the lower metal plate 28. The heating elements 32 and the thermostats 34 are arranged to form a heating cluster 40. In a preferred embodiment, the heating elements 32 and thermostats 34 in each heating cluster 40 occupy a single plane P, and most preferably, a horizontal plane P. In general, a plurality of heating clusters 40 are used in the heating plate 10,12 wherein each heating cluster 40 has a heating device 32 positioned adjacent a temperature control device 34. In one preferred embodiment, each heating cluster 40 has multiple heating elements 32 surrounding a single thermostat 34. Preferably, the heating elements 32 surround the thermostat 34 in a regular pattern. Most preferable, three heating elements 32 surround a single thermostat 34 at a spacing equal to 360 degrees divided by three heating elements 32, or 120 degrees. In this configuration, the heating cluster 40 forms a triangular pattern having a heating element 32 at each point and a thermostat 34 in the middle. While regular spacing of the heating elements 32 about the thermostat 34 is preferred, irregular spacing would also be within the scope of the present invention. The thermostat 34 within any one heating cluster 40 is operably connected with the heating elements 32 by being electrically connected by wires 38 in series with the heating elements 32 of that heating cluster 40. As can be appreciated from FIGS. 1 and 5, the wires 38 are connected to a power supply 7 wherein the power supply 7 is adapted to supply energy to the heating devices 32 and temperature control devices 34. The power supply 7 can be powered from a conventional electrical outlet 44. For clarity, every wire 38 connecting every heating element 32 and thermostat 34 is not shown but one skilled in the art will appreciate that the heating devices 32 and thermostats 34 are electrically connected to the power supply 7.

As further shown in FIG. 5, the heating clusters 40 are arranged in rows 41 and columns 42 on the heating plate 10,12. It is desirable to position the heating clusters 40 such that the heating elements 32 cover the maximum surface area of the plate 10,12 having the least amount of open space without a heating element 32. In order to provide an optimum spacing of the heating elements 32, adjacent heating clusters 40 within a row 41 are rotated with respect to each other by a number of degrees equal to:

360÷(number of heating elements 32 in a heating cluster 40)÷2.

Figure 10:
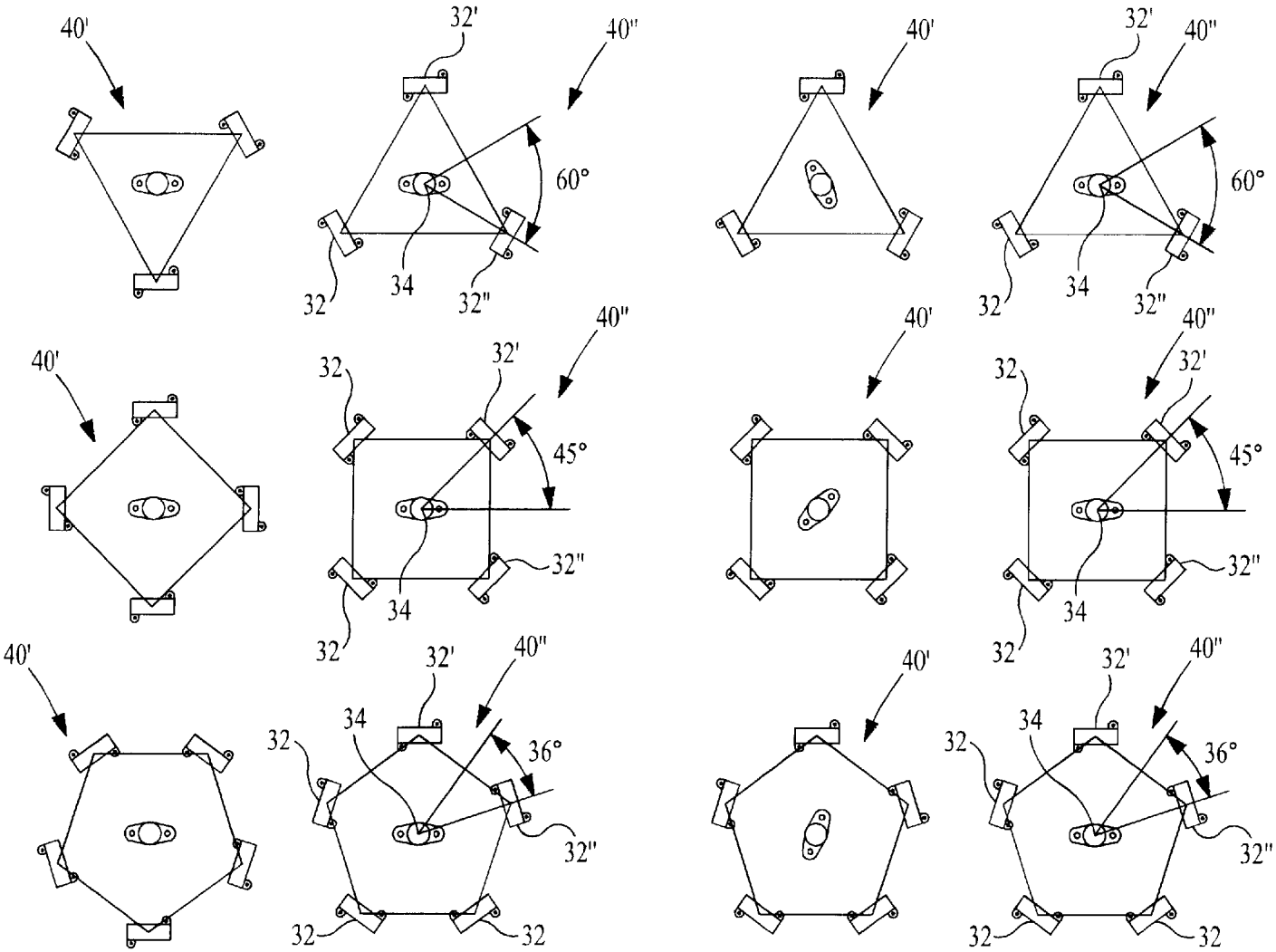
FIG. 10 is a schematic view showing different pairs of rotated heating clusters.

This formula, as described in FIG. 10, provides that adjacent heating clusters 40', 40" be rotated by an amount equal to half of the angle between adjacent heating elements 32', 32".

To illustrate this concept, in FIG. 5 each heating cluster 40 contains three heating elements 32. Thus, a first heating cluster 40' and a second heating cluster 40" are rotated 60 degrees with respect to each other; that is 360÷3(number of heating elements)÷2=60 degrees. With this rotation, the heating elements 32 more optimally cover the surface area of the plate 10,12. If the clusters 40', 40" were not rotated with respect to one another, there would exist more open area without a heating element 32 in the vicinity. FIG. 10 also illustrates this concept wherein adjacent heating clusters 40',40" that are not rotated contain a greater open space therebetween than adjacent heating clusters 40',40" that are positioned rotated with respect to one another, i.e., in a rotated state.

Figure 6:
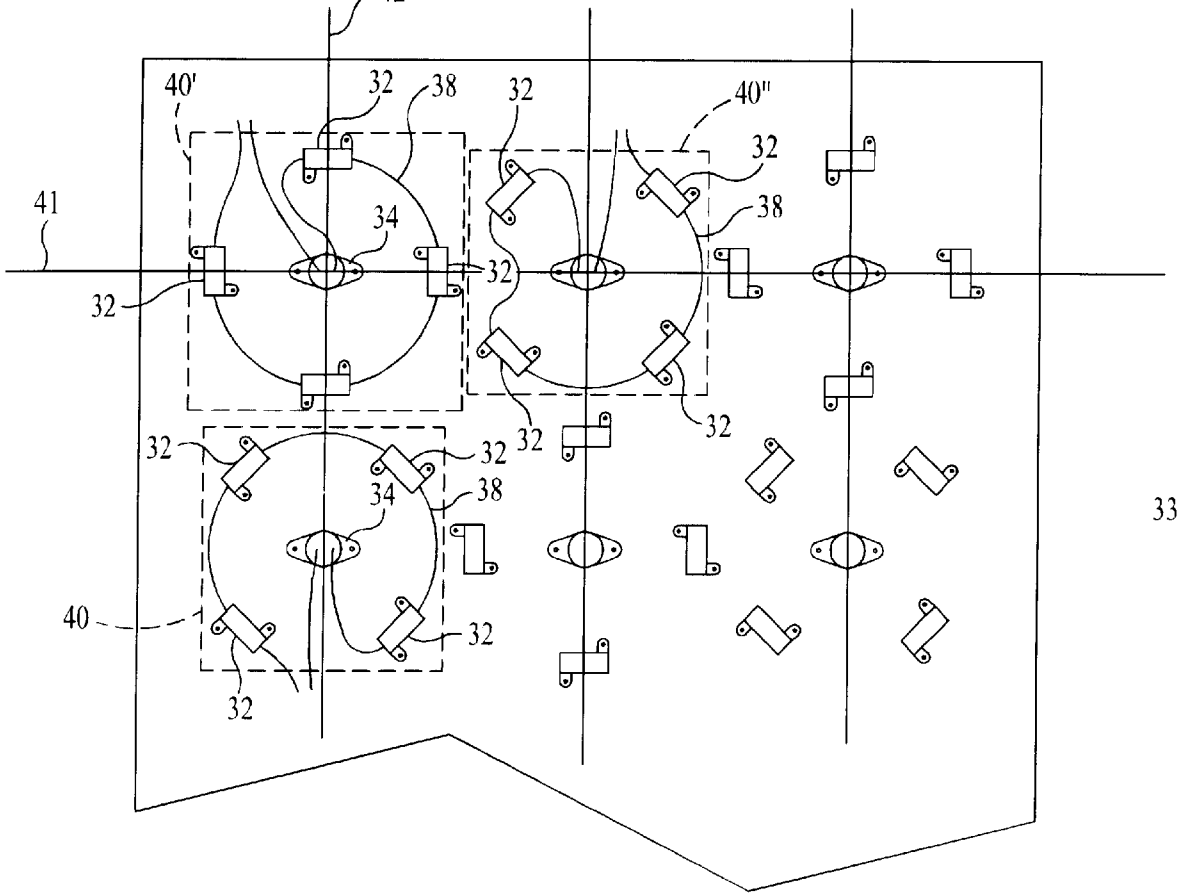
FIG. 6 is a bottom plan view of a portion of a heating plate according to an alternative embodiment of the present invention.

In the example of FIG. 6, each heating cluster 40 contains four heating elements 32. A first heating cluster 40' and a second heating cluster 40" are rotated 360÷4÷2=45 degrees with respect to each other.

Additionally, to provide maximum spacing of heating elements 32 between adjacent rows 41, adjacent heating clusters 40 in columns 42 must be rotated a number of degrees equal to:

360÷(number of heating elements 32 in a heating cluster 40)÷2 when the number of heating elements 32 in a heating cluster is an even number, as shown in FIG. 6. However, when the number of heating elements 32 within a heating cluster 40 is an odd number, maximum coverage is obtained when rows 41 are merely repeated, as shown in FIG. 5, rather than rotating the adjacent heating clusters 40, as shown in FIG. 6.

Optionally, the heating plates 10,12 can also provide safety thermostats 43. The safety thermostats 43 sense the temperature of the heating plates 10,12 between heating clusters 40 and control the power to all heating clusters 40 on the heating plates 10,12. In addition, the upper and lower plates 26, 28 of each heating plate 10,12 can be equipped with safety thermostats 43. In the event an unsafe temperature is detected, such as in the case of a malfunctioning thermostat 34, the safety thermostat 43 would break the power to all heating clusters 40 until the malfunction is repaired.

Figure 7:
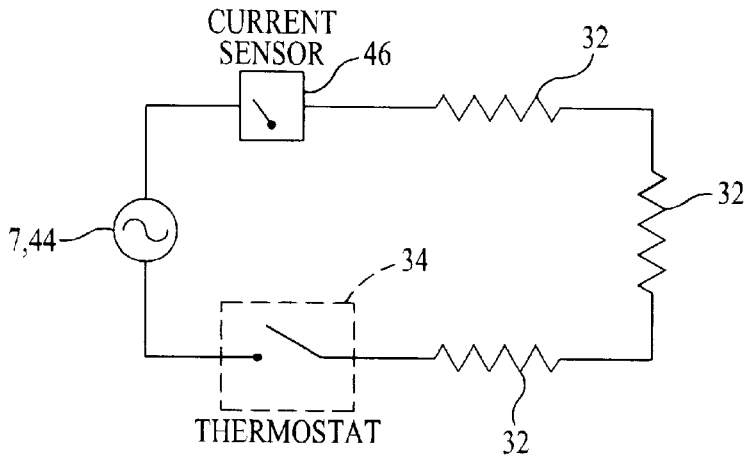
FIG. 7 is a schematic wiring diagram for the heating plate according to the present invention.
Figure 8:
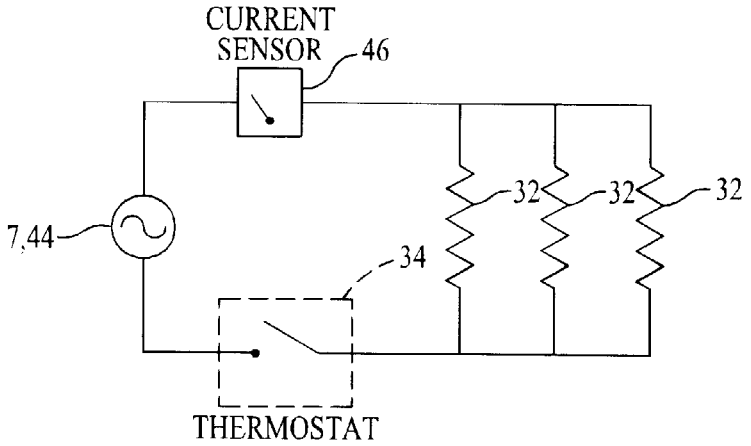
FIG. 8 is an alternative schematic wiring diagram for the heating plate according to the present invention.

Referring to FIGS. 7 and 8, as previously noted, in order to control the heating elements 32 in a particular heating cluster 40, the thermostat 34 is wired in series with the heating elements 32 of that heating cluster 40. Thus, the heating elements 32 may be wired in series, as shown in FIG. 6. Alternatively, the heating elements 32 may also be wired in parallel, as shown in FIG. 8. To complete the circuit, the wires 38 are connected to the power supply 7 which can be powered from a standard power outlet 44. Optionally, a current sensor 46 is provided. The current sensor 46 can provide an indication that the upper heating plate 10 is on.

Figure 9:
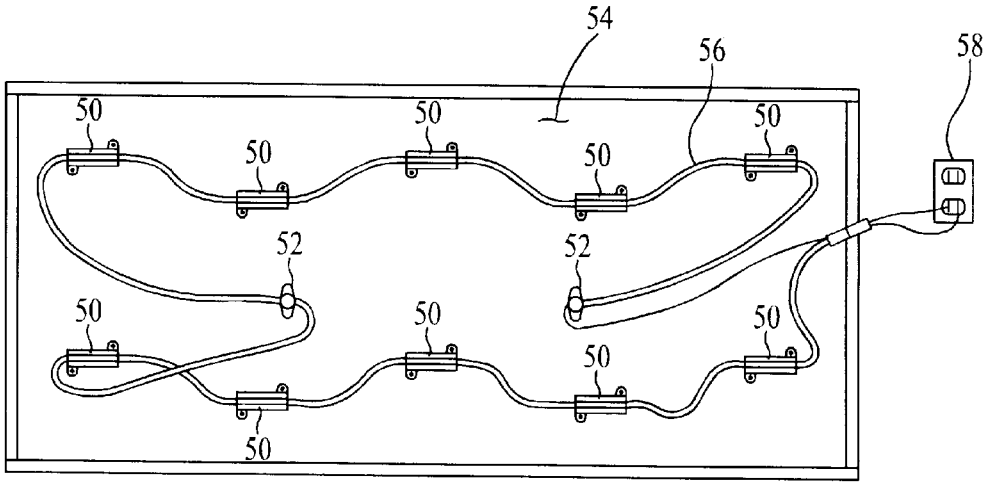
FIG. 9 is a bottom plan view of a heating plate.

Alternatively, referring to FIG. 9, heating elements 50 and thermostats 52 are attached to a heating plate 54. The thermostats 52 and heating elements 50 are electrically connected in series by wires 56. To complete the circuit the thermostats 52 and heating elements 50 are connected in series with a power supply 58. When placed in this arrangement, the temperature at both thermostats 52 must sense a temperature below a predetermined level in order for electrical energy to be provided to the heating elements 50.

Additionally, the heating plates 10,12 can be considered to be divided into a plurality of partitions A, B, C, as shown in FIG. 5. Each partition A, B, C is independently heated and controlled by separate heating clusters 40. In its simplest form, the plate can be divided into two partitions and each partition could have a single heating cluster 40. The heating cluster 40 in turn may have one or more heating devices 32 associated with the heating cluster 40. This configuration provides benefits over previous heating plates because the temperature can be controlled more effectively across the entire heating plate 10,12 rather than having a single thermostat controlling a heating device for the entire plate. In a preferred embodiment, each partition A,B,C itself has multiple heating clusters 40 arranged according to the invention to provide an optimum heat distribution and control configuration. As shown in FIG. 5, the configuration of the heating clusters 40 provide less open spaces in the heating plates 10,12 that would result in inadequate heating. The partitions A, B, C may be kept at identical temperatures or kept at different temperatures to accommodate different types of food items. Actual physical partitions could also be attached to the plates 10,12 to demarcate the partitions A,B,C or the partitions can be formed merely by placement of the heating clusters 40.

In operation, each heating cluster 40 maintains the temperature in its particular section of the heating plate 10,12 by detecting the temperature at the thermostat 34 of the heating cluster 40 and providing electrical energy from the power supply 7,44 to the heating elements 32 of the heating cluster 40 when the temperature drops below a particular value. This allows each section of the heating plate 10,12 to be maintained at a constant temperature and prevents overheating and underheating of any section of the upper heating plate 10.

For example, if an unheated food item is placed upon the upper heating plate 10 in a particular location, for example, cluster 40', the thermostat 34 in that particular location will sense a resulting decrease in the temperature of the heating plate 10 due to conduction heat transfer from the plate 10,12 to the food item. The thermostat 34 will then provide for electrical energy to be supplied to the heating elements 32 within its heating cluster 40 to cause the heating elements 32 to heat that particular section of the heating plate 10. Remote sections of the heating plate 10,12, such as heating cluster 40''', will not decrease in temperature as a result of the placement of the unheated food item at heating cluster 40'. Similarly, thermostats 34 within other heating clusters 40 will not sense a lower temperature and will not provide for electrical energy to the respective heating elements 32 in their heating clusters 40, thus preventing overheating. As a result, the section of the upper heating plate 10 on which the unheated food item was placed will be heated to the required temperature quickly and remote sections of the upper heating plate 10 where the unheated food item was not placed will not be overheated. Overall, the food items placed on the heating plates 10,12, where ever the location, can be heated to the desired temperature with maximum control of the heating.

Furthermore, as discussed, greater temperature control is achieved because each thermostat 34 independently senses temperature at its respective cluster 40. The clusters 40 are grouped and wired such that the heating plate 10,12 is partitioned into separate zones wherein each zone is separately heated and controlled. In this configuration, in addition to a constant temperature, a desired temperature gradient could be achieved across the heating plate if desired such as if different categories of food items were placed on a single heating plate 10,12 but wherein the different food item categories required different heating temperatures.

As discussed, each of the upper and lower heating plates 10,12 are provided with heating clusters 40. In a preferred embodiment, each heating plate 10,12 has heating clusters 40 arranged as shown in FIG. 5. It is further understood that a single heating plate 12 could be used in the food warmer 1 or three or more heating plates could be utilized.

A primary application of the present application is in food warmers. It is understood, however, that the invention can also be applied in other applications where items are required to be heated and wherein it is desirable to optimally control an overall temperature of a heating plate.

While the present invention has been described with reference to electrically resistive heating elements 32 wired through thermostats 34, other heating devices 32 can be used. For example, combustible flame heating elements and a thermostat which controls a supply of combustible fuel to the combustible flame heating elements would be within the scope of the present invention.

Figure 11:
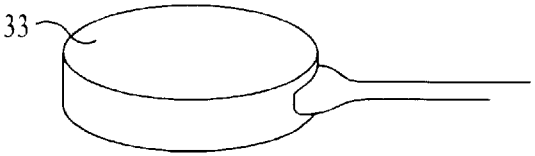
FIG. 11 is a schematic view of an alternative type of heating device.

In addition, while the present invention has been described with reference to multiple heating elements 32 surrounding a single thermostat 34, the multiple heating elements could be replaced by a single heating element which itself surrounds the single thermostat 34 and distributes heat in an area around the thermostat 34. For example, as shown in FIG. 11, a flexible foil heating element 33 could be used wherein a temperature control device 34 could be incorporated into a center portion of the foil element. The flexible foil heating element 33 is a single element that can radially distribute heat. Additionally, the heating devices 32 could be inductive heaters, magnetic resonance heaters, or solid-state devices, such as Peltier devices, in order to heat the plates 10,12. Fluid heaters could also be employed that pump hot fluid through associated pipes and valves. In addition, other temperature control devices could be used such as proportional control devices.

Furthermore, the heating plates 10,12 disclosed are preferably flat, planar surfaces designed to be placed in a substantially horizontal position to support items to be heated such as food items. It is understood, however, that the heating plates 10,12 could take non-planar forms. The heating plates 10,12 can also be positioned in curved configurations and have partitioned zones with heating clusters.

While the specific embodiments have been illustrated and described, numerous modifications come to mind without significantly departing from the spirit of the invention, and the scope of protection is only limited by the scope of the accompanying claims.

We claim:

1. A heating plate comprising:

a support surface adapted to support an article to be heated; and a plurality of heating clusters attached to the surface and substantially evenly distributed across the support surface;

each heating cluster having a temperature control device and a plurality of heating devices spaced around the temperature control device, each heating device operably controlled by the temperature control device, wherein each heating cluster has an equal number of heating devices and adjacent heating clusters within a row of heating clusters are rotated a number of degrees equal to 360 divided by the number of heating devices within one heating cluster divided by two.

2. The heating plate of claim 1 wherein the heating devices are disposed within a single plane.

3. The heating plate of claim 1 wherein the temperature control devices are disposed within a single plane.

4. The heating plate of claim 1 wherein the heating clusters are disposed within a single plane.

5. The heating plate of claim 1 wherein each heating device is an electrically resistive element and the temperature control device is a thermostat, each heating device electrically connected to the temperature control device.

6. The heating plate of claim 1 wherein the plurality of heating devices comprises a foil heating element that distributes heat around the temperature control device.

7. The heating plate of claim 1 wherein the support surface comprises a first thermally conductive plate positioned adjacent a second thermally conductive plate.

8. The heating plate of claim 7 wherein the first thermally conductive plate and the second thermally conductive plate are made from different materials.

9. The heating plate of claim 1 wherein the heating clusters are arranged in a row, wherein adjacent heating clusters within the row are positioned rotated with respect to each other.

10. The heating plate of claim 9 wherein each heating cluster has the same number of heating devices and adjacent heating clusters within the row of heating clusters are positioned rotated a number of degrees equal to 360 divided by the number of heating devices within any one heating cluster divided by two.

11. The heating plate of claim 1 wherein each heating cluster has the same number of heating devices, the number of heating devices being an even number, and adjacent heating devices within a column are positioned rotated with respect to each other.

12. The heating plate of claim 11 wherein each heating cluster has the same number of heating devices, the number of heating devices being an even number, and adjacent heating devices within a column are positioned rotated a number of degrees equal to 360 divided by the number of heating devices within any one heating cluster divided by two.

13. The heating plate of claim 1 wherein each heating cluster has the same number of heating devices, the number of heating devices being an odd number, and adjacent heating devices within a column are not rotated.

14. A heating plate comprising:

a support surface adapted to support an article to be heated, the support surface having a first metal plate positioned adjacent a second metal plate;

a temperature control device attached to the support surface; and a plurality of heating devices attached to the support surface and positioned around the temperature control device, each heating device operably controlled by the temperature control device, the temperature control device and heating devices positioned in a single plane, wherein the heating devices positioned around the temperature control device comprise a heating cluster wherein a plurality of heating clusters are attached to the support surface, the heating clusters positioned in a row and adjacent heating clusters within the row are positioned such that the heating elements of the heating clusters are positioned rotated with respect to each other.

15. The heating plate of claim 14 wherein the plane is substantially horizontal.

16. The heating plate of claim 14 wherein the support surface has a bottom surface and a top surface, the temperature control device and heating devices attached to the bottom surface and the top surface being adapted to support the article to be heated.

17. The heating plate of claim 14 wherein each heating device is an electrically resistive element electrically connected to the temperature control device.

18. The heating plate of claim 14 wherein the first metal plate is stainless steel and is adapted to support the article to be heated and the second metal plate is aluminum and supports the temperature control device and heating devices.

19. The heating plate of claim 14 wherein each heating cluster has an equal number of heating devices and adjacent heating clusters within the row are rotated a number of degrees equal to 360 degrees divided by the number of heating devices within a heating cluster divided by two.

20. The heating plate of claim 14 wherein three heating devices are connected to the support surface and positioned circumferentially around the temperature control device in a triangular pattern to define a first heating cluster.

21. The heating plate of claim 14 wherein the heating elements are spaced around the heating control device 120 degrees from each other.

22. The heating plate of claim 20 further comprising a second temperature cluster, the second heating cluster being positioned rotated 60 degrees with respect to the first heating cluster.

23. The heating plate of claim 21 wherein the heating devices are operably controlled by the temperature control device by wires connecting the heating devices and the temperature control device in series.

24. The heating plate of claim 14 wherein the heating devices are powered from a conventional power supply.

25. A heating plate comprising:

a support surface adapted to support an article to be heated; and a first heating cluster attached to the support surface, the heating cluster having a temperature control device and a plurality of heating elements circumferentially spaced around the temperature control device, each heating element operably controlled by the temperature control device, the heating elements spaced around the temperature control device substantially 120 degrees from each others;

a second heating cluster being connected to the support surface and being adjacent the heating cluster and being positioned rotated substantially 60 degrees from the first heating cluster.

26. A heating plate comprising:

a support surface adapted to support an article to be heated;

a first heating cluster attached to the support surface, the heating cluster comprising:

a temperature control device; and three heating devices positioned around the temperature control device;

a second heating cluster attached to the support surface, the second heating cluster comprising:

a temperature control device; and three heating devices positioned around the temperature control device; and the first and second heating clusters located within a single plane and rotated with respect to each other by sixty degrees.

27. A heating plate comprising:

a support surface adapted to support an article to be heated and wherein the support surface comprises a first thermally conductive metal plate positioned adjacent a second thermally conductive metal plate; and a plurality of heating clusters attached to the surface;

each heating cluster having a temperature control device and a heating device positioned adjacent the temperature control device, the heating device operably controlled by the temperature control device wherein the heating clusters are positioned in a row and adjacent heating clusters within the row are positioned such that the heating elements of the heating clusters are positioned rotated with respect to each other.

28. The heating plate of claim 27 wherein the heating devices are disposed within a single plane.

29. The heating plate of claim 27 wherein the temperature control devices are disposed within a single plane.

30. The heating plate of claim 27 wherein the heating clusters are disposed within a single plane.

31. The heating plate of claim 27 wherein the first thermally conductive plate and the second thermally conductive plate are made from different materials.

32. A food warmer comprising:

a base;

a pair of side supports connected to the base;

a rear support connected to the base and side supports, a top cover connected to the side supports and rear support, the base, side supports, top support and rear supports cooperatively defining a chamber therein;

a heating plate positioned in the chamber, the heating plate having a stainless steel plate having a top surface adapted to support food items to be heated, the heating plate further having an aluminum plate connected to and positioned beneath the stainless steel plate, the aluminum plate having a bottom surface;

a plurality of heating clusters attached to the bottom surface, each heating cluster comprising:

a heating control device;

a plurality of heating devices spaced around the heating control device, each heating device operably controlled by the heating control device, adjacent heating clusters positioned rotated with respect to each other; and a power supply operably connected to the heating clusters.

33. A heating plate comprising:

a support surface adapted to support an article to be heated, the support surface partitioned into a plurality of zones, each zone being independently heated and controlled; and a plurality of heating clusters attached to the support surface in each zone, each heating cluster having a temperature control device and a plurality of heating devices positioned around the temperature control device, the heating device operably controlled by the temperature control device;

wherein adjacent heating clusters are positioned rotated with respect to one another to provide an optimum spacing of heating elements.

34. A heating plate comprising:

a support surface adapted to support an article to be heated and wherein the support surface comprises a first thermally conductive metal plate positioned adjacent a second thermally conductive metal plate; and a plurality of heating clusters attached to the surface;

each heating cluster having a temperature control device and a plurality of heating devices spaced around the temperature control device, each heating device operably controlled by the temperature control device wherein the heating clusters are positioned in a row and adjacent heating clusters within the row are positioned such that the heating elements of the heating clusters are positioned rotated with respect to each other.

* * * * *